United States Patent [19]

Pansini

[11] 4,348,192

[45] Sep. 7, 1982

[54] AUTOMATIC POOL CLEANER

[75] Inventor: Andrew L. Pansini, Belvedere, Calif.

[73] Assignee: Jandy Industries, Inc., San Rafael, Calif.

[21] Appl. No.: 236,774

[22] Filed: Feb. 23, 1981

[51] Int. Cl.[3] ..... B64C 21/06; B08B 3/02; B08B 9/08

[52] U.S. Cl. ..... 440/38; 4/490; 134/167 R; 239/229

[58] Field of Search ..... 134/167 R, 168 R; 440/38–40; 15/1, 7; 239/229; 4/490, 492

[56] References Cited

U.S. PATENT DOCUMENTS 3,665,942 5/1972 Moore ..... 440/38 X
3,921,654 11/1975 Pansini ..... 134/167 R
4,007,749 2/1977 Pansini ..... 134/167 R
4,023,581 5/1977 Pansini et al. ..... 134/167 R
4,129,904 12/1978 Pansini ..... 134/167 R X
4,281,995 8/1981 Pansini ..... 440/38

*Primary Examiner*—Robert L. Bleutge
*Attorney, Agent, or Firm*—Naylor, Neal & Uilkema

[57] ABSTRACT

A swimming pool cleaner of the random movement type having a surface transporter which rollingly engages the pool walls and a jet drive which reverses or changes direction when the transporter is stopped or slowed is provided with additional controls which as a consequence of the turning movement of the transporter against the deep end pool wall causes the transporter to travel back and forth along said deep end wall and thereby spend more time along said wall.

8 Claims, 11 Drawing Figures

AUTOMATIC POOL CLEANER

BACKGROUND OF THE INVENTION

The invention relates to the type of cleaner which moves cleaning nozzles, either on trailing whip-like acting cleaning hoses or on the water supply hose itself, around the pool and which has a transporter which is self-reversing in its direction of movement as a consequence of being stopped or slowed down by its engagement with pool wall surfaces. The transporter has a pivot connection with the supply hose to enable the transporter to roll in engagement with the pool wall surfaces without disturbing the orientation of the supply hose and its cleaning nozzle means.

With such cleaners, when they are operated without being supplied by a booster pump in the water supply system and in the absence of automatic on and off cycling of the supply water, sometimes encounter problems in cleaning the deep end walls of pools. The transporter has a tendency under such circumstances to race around the deep end bowl of the pool trailing the cleaning hoses or cleaning nozzles away from the deep end wall. If the cleaner is slowed down, as by decreasing the supply pressure of the water, the cleaner may not have enough power to work itself free of the pool steps. What is needed is a greater number of reversals of the transporter than is normally obtainable due to slowing or stopping of the transporter by its interengagement with pool wall surfaces. The obtaining of more reversal cycles of the transporter would allow the cleaning hoses or cleaning nozzles to settle better against or adjacent the deep end pool wall.

The present invention has for its primary object the provision of new and novel means in such cleaners for increasing the rate of transporter reversal while the transporter is disposed in adjacent relation to the deep end wall of the pool.

The accomplishment of this object is achieved by providing the transporter with means operable while the transporter is rotating against the pool wall to slow down the rate of movement of the transporter along this pool wall, thereby allowing the supply hose to overtake the transporter and cause a reversal of the movement of the transporter. This serves to increase the time during which the transporter remains in the deep end of the pool in back and forth engagement with the deep end wall, thereby creating the desired deep end wall cleaning effect either with the whip hoses or the supply line cleaning nozzles, or both.

Other objects and advantages of the invention will be apparent from the following description taken in conjunction with the drawings forming part of this specification.

DESCRIPTION OF THE PREFERRED EMBODIMENTS

Figure 1:
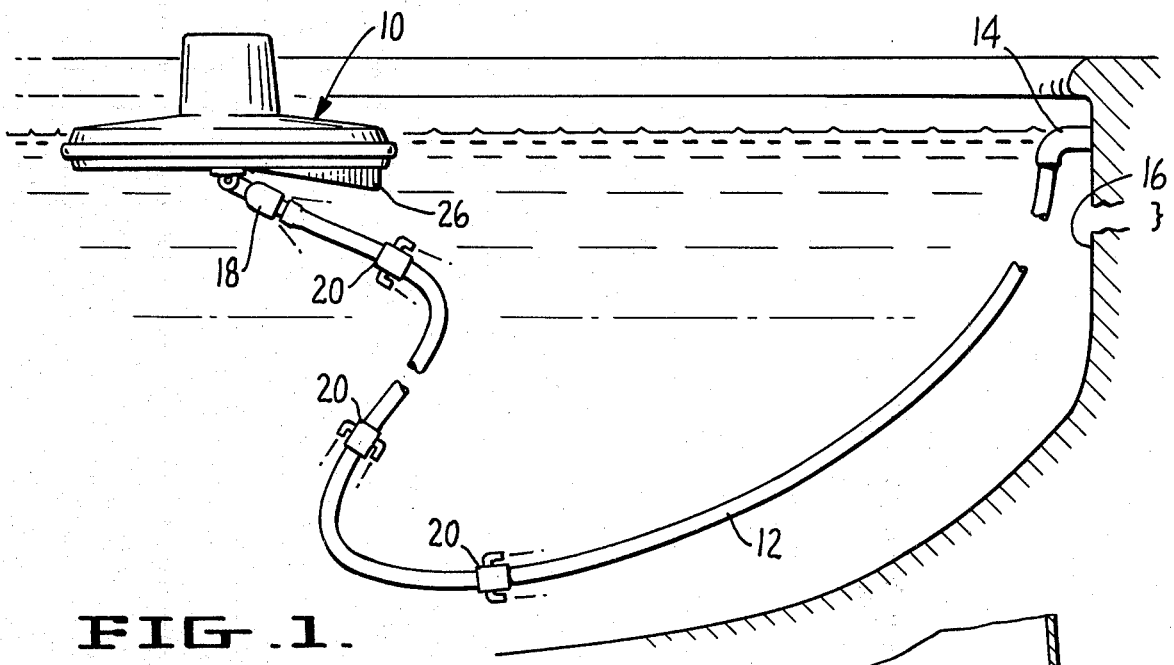
FIG. 1 is a view in side elevation of one embodiment of the subject improved cleaner.
Figure 2:
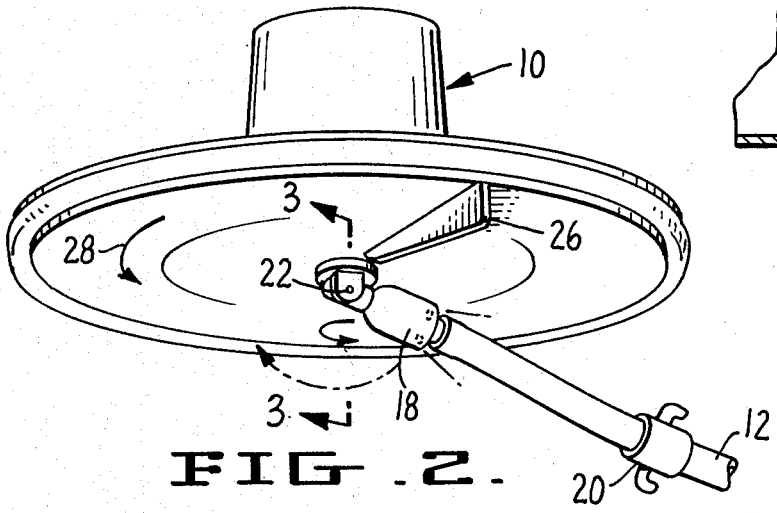
FIG. 2 is a view in perspective directed toward the underside of the transporter of the cleaner of FIG. 1.
Figure 3:
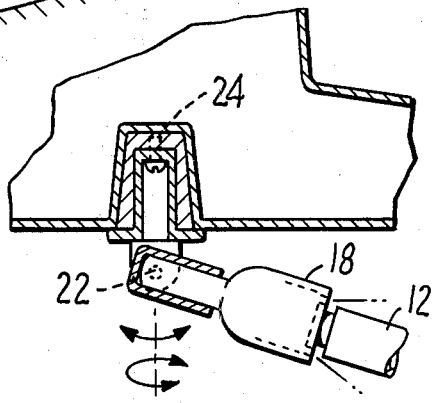
FIG. 3 is a view taken along lines 3—3 of FIG. 2.

With reference to FIGS. 1–3, the cleaner comprises a round, disc-like transporter 10, a water supply hose 12 having a connection 14 with the pool wall 16 and having its other end attached in supply relation to the transporter drive nozzle 18. The hose 12 is provided with a plurality of jet nozzle elements 20 which serve to tension the supply hose and drive it around the pool and also serve as cleaning nozzles for the pool wall and floor surfaces. The transporter drive jet nozzle 18 has a swivel connection comprising horizontal pivot axis 22 and vertical pivot axis 24 with the center of transporter 10. The transporter 10 is provided at its underside with a fixed rudder element 26.

The operation of the embodiment of FIGS. 1–3 is as follows. When the transporter 10 is underway out in the pool, the rudder 26 lines up with the leading end of the supply hose 12, that is, it is aligned with the line of travel of the transporter.

FIG. 2 illustrates the transporter as being disposed in rolling relation to a pool wall, the directional arrow 28 indicating that the transporter disc is rotating in a counter-clockwise direction, as viewed from the underside of the disc, signifying that the transporter is moving along the pool wall to the left, as viewed in FIGS. 1 and 2. At the commencement of this turning movement of the transporter the rudder 26 was lined up over the supply hose, but as the transporter turns the rudder rotates into a progressively greater movement-impeding position until maximum impedance is obtained at 90°. This slows the disc down to the point where the jets 20 tend to drive the supply hose 12 past the transporter drive jet 18, thereby swinging the latter about the pivot 22 to a reversed position in which it drives the transporter in the opposite direction. This causes the transporter to roll to the right along the pool wall, and once again the rudder 26 moves out of a position where it is lined up over the leading end of the supply hose into a progressively greater movement impeding position, resulting once again in a reversal of movement of the transporter. Thus it can be seen that the rudder 26 functions to cause the transporter to reverse its direction repetitively while the transporter remains in engagement with the deep end wall of the pool. The result is that the transporter remains for longer periods of time along the deep end wall of the pool. After a while the transporter breaks free from the deep end wall and moves out in the pool. As it leaves its wall position the rudder 26 once again aligns itself with the transporter end of the supply hose 12.

Figure 4:
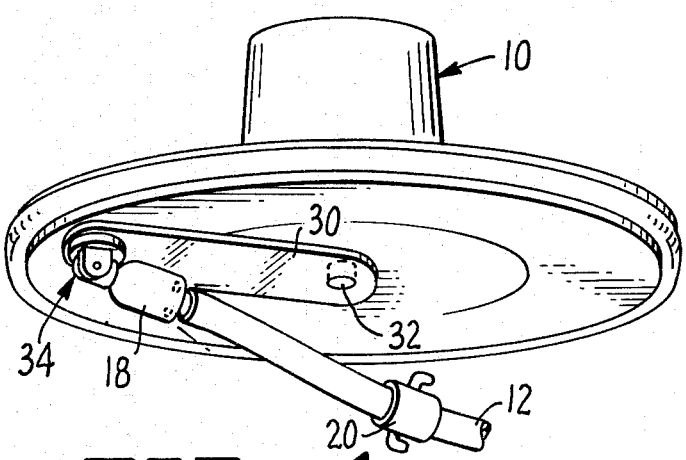
FIG. 4 is a view like that of FIG. 2 but showing a further embodiment of the subject improved cleaner.

In the embodiment of FIG. 4 the connection between the drive jet 18 and the transporter 10 comprises a link or lever arm 30 having one end pivotally connected to the transporter 10 adapting it to rotate in a horizontal plane and having the other end swivelly connected to the jet nozzle 18 through swivel joint 34. In other words the jet nozzle 18 can rotate about a horizontal axis and about a vertical axis, in the manner of the swivel connection shown in FIG. 3, relative to the outer end of link 30.

When the cleaner of FIG. 4 is underway out in the pool, e.g. moving to the left as viewed in FIG. 4, the jet nozzle 18 pulls the transporter forwardly through link 30. When the transporter becomes stopped or slowed, the supply hose tensioning and drive jets 20 (not shown in FIG. 4) drive the jet nozzle about the horizontal pivot of the swivel joint 34 to a reversed position wherein the drive jet tends to push the transporter through the link 30. This causes the link to rotate through approximately 180° to a point where the jet again pulls the link 30 which in turn pulls the transporter.

When the transporter moves into rolling engagement with the deep end wall of the pool, the drag effect on the transporter slows it down, causing a reversal of the jet 18, as above-described. By a successive of such reversals, the transporter of the FIG. 4 embodiment is caused to spend more time along the deep end wall of the pool.

Figure 5:
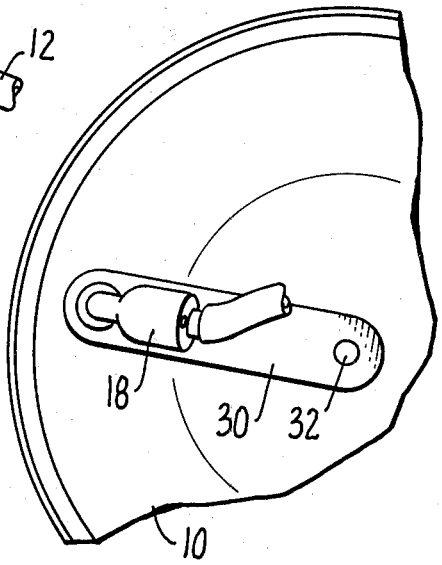
FIG. 5 is a partial bottom plan view of a modification of the embodiment of FIG. 4.

In FIG. 5 the drive jet 18 does not have a swivel connection with the link 30 but only a pivotal connection about a vertical axis. The cleaner will still operate in the manner described. The same can be done with respect to the embodiment of FIGS. 1–3, i.e. the pivot axis 22 could be frozen so that the jet nozzle 18 turns only about the vertical axis 24 relative to transporter 10.

In the embodiment of FIGS. 6–11, the jet nozzle 18 is swivelly connected to transporter 10 through swivel joint 36 which is similar to joint 34 in FIG. 4. The swivel joint 36 has an off-center connection with the transporter 10. In normal operation when the transporter is out in the pool and away from the pool walls, the swivel joint 36 travels in advance of the geometrical center of the transporter, i.e. the jet action pushes the swivel joint which pulls the transporter.

Figure 6:
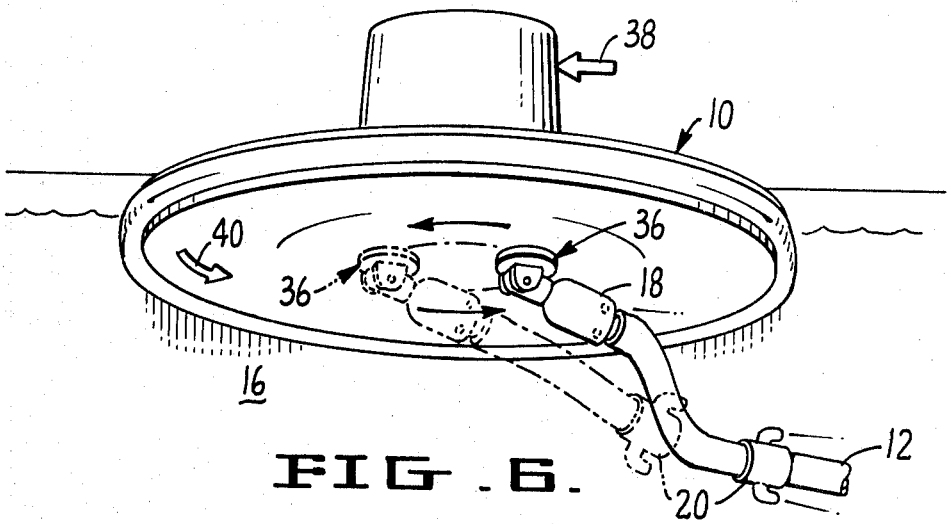
FIG. 6 is a view like that of FIG. 2 of another embodiment of the improved subject cleaner.
Figure 7:
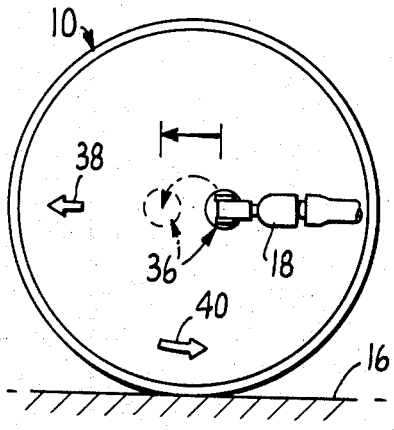
FIG. 7 is a bottom plan view of the cleaner of FIG. 6 in one condition of operation.
Figure 9:
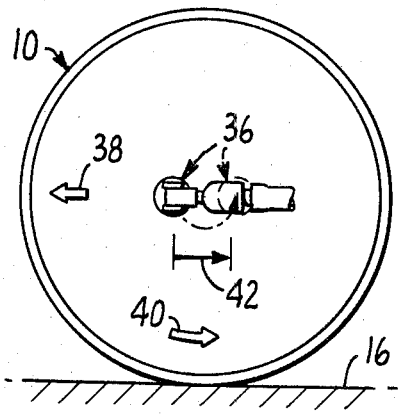
FIG. 9 is a bottom plan view of the cleaner of FIG. 6 in another condition of operation.
Figure 8:
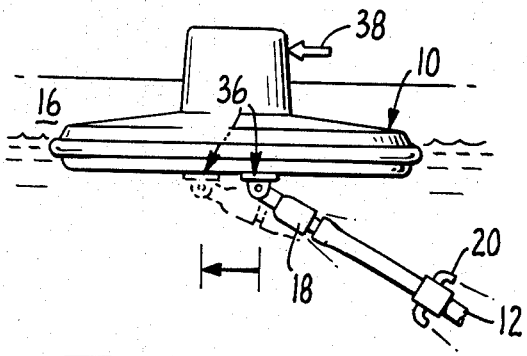
FIG. 8 is a view in side elevation of the cleaner of FIG. 7.
Figure 10:
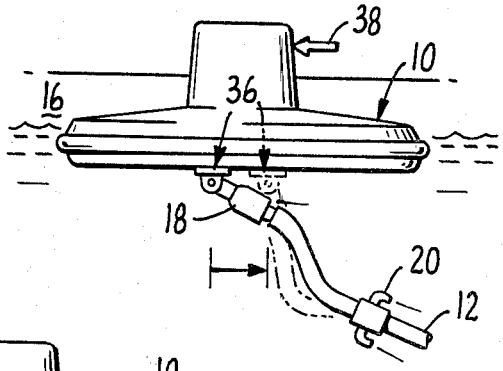
FIG. 10 is a view in side elevation of the cleaner of FIG. 9.
Figure 11:
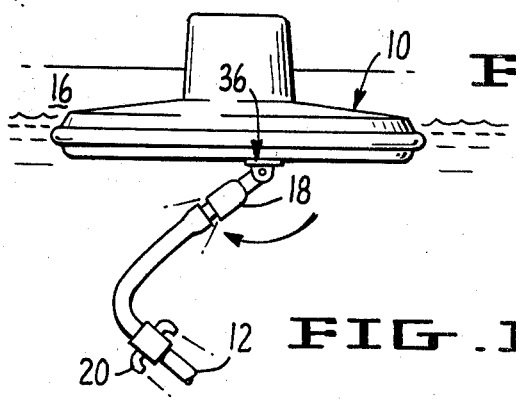
FIG. 11 is another view in side elevation of the cleaner of FIG. 6.

In FIG. 6, the transporter is in rolling engagement with the deep end wall. It is moving to the left as indicated by arrow 38 and is rotating in a counter-clockwise direction (when viewed from the underside) as indicated by arrow 40. The swivel swings from the dotted line position in FIG. 6 to the solid line position which means that the jet nozzle has lost ground to the extent of the negative direction arrow 42 in FIG. 9 relative to the rolling movement forwardly along the wall of the transporter. This slowing of the forward movement of the jet nozzle 18 causes the jets 20 to drive the jet 18 into a reversal which causes the transporter to rotate along the wall in the opposite direction. The rolling of the transporter in the new direction causes the swivel joint 36 to move about the geometrical center of the transporter to a position where it trails the geometrical center. This results in another jet reversal inasmuch as such a movement of the swivel joint is sensed as a slowing down of the forward travel of the jet nozzle 18.

What is claimed is:

1. In an automatic pool cleaner comprising a transporter adapted to rollingly engage pool side walls, a drive jet nozzle for the transporter having a pivotal connection therewith whereby said nozzle may drive said transporter randomly about a pool, a water supply hose connected to said nozzle, and jet driving means for the supply hose operable when said transporter is slowed along a forward line of direction to re-orient said drive jet nozzle and drive said transporter along a rearward line of direction: the provision in combination therewith of means carried by said transporter operable due to the turning of said transporter as it travels in rolling engagement with a pool side wall to slow said transporter in its direction of movement and re-orient said drive jet nozzle to drive said transporter in the opposite direction along said pool wall.

2. The combination of claim 1, said last-mentioned means comprising a rudder element extending radially along the underside of said transporter.

3. The combination of claim 1, said last-mentioned means comprising a link disposed at the underside of said transporter, said link having its proximal end pivotally connected to said transporter at the central vertical axis thereof and having its distal end pivotally connected to said drive jet nozzle.

4. The combination of claim 1, said last-mentioned means comprising a swivel joint interconnecting said transporter and said drive jet nozzle, said joint being located in offset relation to said axis of said transporter.

5. An automatic pool cleaner comprising a transporter substantially circular in outline so as to engage and roll against and be rotated by a pool wall, a drive jet nozzle for the transporter having a pivotal connection therewith for random movement of the transporter about a pool, a water supply hose connected to said nozzle, said nozzle being adapted to be re-oriented to a reversing direction when the forward movement of the transporter is impeded, and means carried by said transporter operable as a consequence of the rotation of said transporter as it rolls along a pool wall to impede the forward movement along said wall of said transporter and thereby cause said nozzle to be reversed.

6. The cleaner of claim 5, said last-mentioned means comprising a rudder element extending radially along the underside of said transporter.

7. The cleaner of claim 5, said last-mentioned means comprising a link disposed at the underside of said transporter, said link having its proximal end pivotally connected to said transporter at the central vertical axis thereof and having its distal end pivotally connected to said drive jet nozzle.

8. The cleaner of claim 5, said last-mentioned means comprising a swivel joint interconnecting said transporter and said drive jet nozzle, said joint being located in offset relation to said axis of said transporter.

* * * * *